US006325434B1

(12) United States Patent
Takao et al.

(10) Patent No.: US 6,325,434 B1
(45) Date of Patent: Dec. 4, 2001

(54) TONGS APPARATUS EQUIPPED WITH SUPPLEMENTAL-HOLDING-FORCE APPARATUS

(75) Inventors: Seiyu Takao; Yuichi Ono; Kazuhiro Tanaka, all of Chigasaki; Kazuo Izumi, Tokyo, all of (JP)

(73) Assignee: Toho Titanium Co., Ltd. (JP)

( * ) Notice: Subject to any disclaimer, the term of this patent is extended or adjusted under 35 U.S.C. 154(b) by 0 days.

(21) Appl. No.: 09/590,292

(22) Filed: Jun. 9, 2000

(30) Foreign Application Priority Data

Jun. 14, 1999 (JP) ..... 11-167436

(51) Int. Cl.[7] ..... B66C 1/42
(52) U.S. Cl. ..... 294/118; 294/119
(58) Field of Search ..... 294/110.1, 111, 294/112, 115, 116, 118, 119

(56) References Cited

U.S. PATENT DOCUMENTS

| | | | | |
|---|---|---|---|---|
| 1,839,389 | * | 1/1932 | Heppenstall | 294/110.2 |
| 2,215,844 | * | 9/1940 | Syckle | 294/116 |
| 2,745,694 | * | 5/1956 | Wagemann | 294/111 |
| 2,985,481 | * | 5/1961 | Janoff | 294/118 |
| 3,125,370 | * | 3/1964 | McGill | 294/115 |
| 3,163,457 | * | 12/1964 | Renfroe | 294/101 |
| 3,330,590 | * | 7/1967 | Sheidan et al. | 294/111 |
| 3,348,872 | * | 10/1967 | Kolinski | 294/119 |
| 3,359,033 | * | 12/1967 | Curtis | 294/111 |
| 3,674,302 | * | 7/1972 | Mutch | 294/118 |
| 3,948,552 | * | 4/1976 | Hamrick | 294/118 |
| 3,975,045 | | 8/1976 | Abarotin et al. | 294/86.4 |
| 4,169,622 | | 10/1979 | Classen et al. | 294/118 |
| 4,199,184 | | 4/1980 | Achelpohl | 294/106 |
| 4,262,952 | | 4/1981 | Bradley | 294/118 |
| 4,709,953 | | 12/1987 | Sirota | 294/406 |
| 5,061,150 | | 10/1991 | Rentschler | 294/88 |
| 5,558,380 | | 9/1996 | Meyer et al. | 294/88 |

FOREIGN PATENT DOCUMENTS

| | | | | |
|---|---|---|---|---|
| 0216175 | * | 4/1987 | (EP) | 294/112 |
| 2374253 | * | 8/1978 | (FR) . | |
| 1553505 | * | 3/1990 | (SU) | 294/110.1 |
| 2148845 | * | 3/1990 | (GB) | 294/110.1 |
| 1331800 | * | 8/1987 | (SU) | 294/111 |

* cited by examiner

*Primary Examiner*—Donald P. Walsh
*Assistant Examiner*—Paul T. Chin
(74) *Attorney, Agent, or Firm*—Lorusso & Loud

(57) ABSTRACT

A tongs apparatus includes an upper frame suspended from a crane, a pair of first arms journaled on the upper frame, a pair of second arms journaled on the first arms and disposed to cross each other, and a supplemental-holding-force apparatus. The supplemental-holding-force apparatus comprises a chain motor; a chain wound and unwound by the chain motor; a ring-shaped member connected to the chain and having an elongated hole; and a lifting metal fitting having a guide pin slidably engaged with the ring-shaped member. The chain is wound or unwound by the chain motor in order to move the ring-shaped member vertically to thereby supplement a holding force generated through closing of the second arms.

12 Claims, 6 Drawing Sheets

TONGS APPARATUS EQUIPPED WITH SUPPLEMENTAL-HOLDING-FORCE APPARATUS

BACKGROUND OF THE INVENTION

1. Field of the Invention

The present invention relates to a tongs apparatus, and more particularly to a tongs apparatus capable of providing supplemental holding force.

2. Description of the Related Art

Conventionally, when a crane or a like machine is used to suspend an object, such as a piece of titanium sponge, a log, or a piece of concrete, which has a relatively soft surface layer and a cylindrical shape that is difficult to grasp, or is used to change the orientation of the object from a horizontal orientation to a vertical orientation, or vice versa, a wire, a chain, or the like is used as a holding jig in order to perform the suspending and orientation-changing operation in preparation for various machining processes.

However, in many cases an object, such as a piece of titanium sponge, which is used as an industrial material is large and heavy, and therefore skill is required in an operation of holding such a large and heavy object, in a well-balanced manner, by use of a holding jig and suspending the object by use of the crane. Therefore, a suspending method which improves work efficiency has been desired.

FIG. 5 shows a tongs apparatus 100, which is an example of a known tongs apparatus for suspending a heavy object. Generally, the tongs apparatus 100 is attached to a hook of a crane and is used to suspend an object, such as a piece of steel, aluminum, stone, or any other material.

The tongs apparatus 100 includes an engagement member 102 provided on the crane side of the apparatus 100; an engagement pin 101 which engages a hook (unillustrated) of the crane; paired cross arms 104 for holding an object; tension bars 103 rotatably connected to the cross arms 104; a frame 105 to which the cross arms 104 are rotatably connected; and a stopper 106 disposed under the frame 105 and capable of contacting the upper face of the object.

The tongs apparatus 100 is equipped with a lock mechanism consisting of a tong male key 110*a* and a tong female key 110*b*. The tong male key 100*a* is provided on the engagement member 102 side, and the tong female key 110*b* is provided on the stopper 106. The cross arms 104 of the tongs apparatus 100 are held in an opened state by the lock mechanism.

The lock mechanism is locked through an operation of lowering a crane hook in a state in which the stopper 106 is placed on an object or a frame and the cross arms 104 are opened outward. That is, when the crane hook is lowered, the tong male key 110*a* enters the tong female key 110*b*. As a result, a projection provided on the tong male key 110*a* rotates, and thus, the lock mechanism is brought into a locked state. In a locked state, the cross arms 104 do not close even when the tongs apparatus 100 is pulled upward by the crane.

When an object is to be suspended by use of the tongs apparatus 100, the tongs apparatus 100 in which the lock mechanism is in the locked state and the cross arms 104 are in the opened state is suspended from the crane. Subsequently, the tongs apparatus 100 is positioned above the object.

Subsequently, when the lock mechanism is unlocked, the cross arms 104 close due to their weights, so that the distal ends of the cross arms 104 come into contact with the object.

The unlocking of the lock mechanism is effected through an operation of lowering the crane hook in a state in which the stopper 106 is placed on the object or the frame, so that the projection of the tong male key 110*a* rotates, and the tong male key 110*a* is released from the tong female key 110*b*. Thus, the lock mechanism is unlocked. When the crane hook is raised, due to the weight of the object and that of the tongs apparatus, the cross arms 104 intrude into the object, which enables holding of the object.

When the cross arms 104 are to be opened again after the object has been moved to a desired position, the crane hook is lowered such that the stopper 106 of the tongs apparatus 100 is placed on the object. When the crane hook is lowered further, the tension bars 103 and the cross arms 104 rotate about pins 108 and pins 109, respectively, such that the angles formed between the tension bars 103 and the cross arms 104 become smaller. As a result, the cross arms 104 are opened.

However, in the tongs apparatus 100 shown in FIG. 5, the stopper 106 must be placed on the object or frame in order to open or close the cross arms 104 and unlock the lock mechanism. Therefore, when the stopper 106 is placed on a cylindrical object, such as a piece of titanium sponge, whose outer diameter is not constant, and whose outer circumference is uneven, the relative positions of the distal ends of the cross arms change depending on the outer diameter of the object, so that holding a desired portion becomes difficult.

In order to solve the above-described problem, a tongs apparatus as shown in FIG. 6 has been proposed. In this tongs apparatus, cross arms are opened and closed through vertical movement of a motor-driven chain in order to hold an object at a desired position. Specifically, the tongs apparatus 100 shown in FIG. 6 has a chain motor 114 disposed on the engagement member 102 provided on the crane side. A hook 112 is provided at the lower end of a chain 111 extending from the chain motor 114. The hook 112 has a configuration that enables the hook 112 to engage a lifting pin 113*a* of a lifting block 113 provided on a base plate 107. When the chain 111 is wound up by the chain motor 114, the cross arms 104 open.

Further, a safety device (unillustrated) is added to the tongs apparatus 100 shown in FIG. 6 in order to protect the chain motor 114 and the chain 111. The safety device includes a limit switch or a proximity switch for detecting the fully opened state of the cross arms 104 and automatically stops the chain motor 114 when the cross arms 104 are fully opened.

When an object is suspended by use of the tongs apparatus 100 shown in FIG. 6, the engagement pin 101 is brought into engagement with the hook (unillustrated) of the crane. Subsequently, the crane is operated to lift the tongs apparatus 100 and move it to a position above the object. Subsequently, the chain motor 114 of the tongs apparatus 100 is operated in order to unwind the chain 111. As a result, due to the weights of the cross arms 104, forces act on the cross arm 104 inward or in a closing direction.

When the inner sides of the cross arms 104 come into contact with the object, the safety apparatus stops unwinding of the chain, while the chain 111 is slightly slackened. Thus, a holding position of the object is determined. Since the chain 111 is slightly slackened, due to the weights of the cross arms 104, forces further act on the cross arms 104 inward or in a closing direction. At this time, if the chain is caused to slack excessively, the chain may entangle. Therefore, the limit switch or proximity switch detects such slack and adjusts the length of the unwound portion of the chain 111 in order to prevent such excessive slack.

Subsequently, the tongs apparatus is lifted by use of the crane. At this time, due to the weights of the object and the tongs apparatus, forces further act on the cross arms 104 inward or in a closing direction. In this manner, the object is held by the cross arms 104, lifted by means of the crane, and changed in orientation.

When the tongs apparatus 100 shown in FIG. 6 lifts a hard object such as a piece of copper, aluminum, or stone, the cross arms 104 can hold and suspend the object. However, when the cross arms 104 hold an object having a soft surface layer such as titanium sponge, the unwinding of the chain 111 is stopped immediately after the cross arms 104 come into contact with the surface layer, with the result that the object cannot be held reliably.

That is, lifting of the tongs apparatus is started before the distal ends of the cross arms 104 intrude into the inner hard portion of the object. In such a case, the cross arms 104 cannot lift the object, and instead fracture the surface layer of the object.

SUMMARY OF THE INVENTION

An object of the present invention is to provide a tongs apparatus which supplements holding force in order to reliably suspend an object even when the object has a soft surface layer or when the object does not have a constant shape.

The present invention provides a tongs apparatus comprising: an upper frame suspended from a crane; a pair of first arms journaled on the upper frame; a pair of second arms journaled on the first arms and disposed to cross each other; and a supplemental-holding-force apparatus.

The supplemental-holding-force apparatus comprises: a chain motor provided on the upper frame; a chain wound and unwound by the chain motor; a ring-shaped member connected to a lower end of the chain and having an elongated hole; and a lifting metal fitting disposed at a crossing point of the second arms or a position closer to the distal ends of the second arms, the lifting metal fitting having a guide pin slidably engaged with the ring-shaped member. The chain is wound or unwound by the chain motor in order to move the ring-shaped member vertically to thereby supplement a holding force generated through closing of the second arms.

In the present invention, since the ring-shaped member is interposed between the chain and the lifting metal fitting, within a range corresponding to the length of the elongated hole of the ring-shaped member, the second arms can be moved further in the closing direction from the positions at which the second arms come into contact with an object.

That is, when an object having a soft surface layer is to be suspended, after the second arms are brought into contact with the surface layer of the object which is placed at a certain location, the chain is further unwound in order to lower the ring-shaped member until the upper end portion of the elongated hole of the ring-shaped member comes into contact with the guide pin. Due to the weights of the first and second arms, forces for further moving the second arms downward act on the second arm. As described above, the operation of lowering the ring-shaped member enables the distal ends of the second arms to move further in the closing direction, with no possibility of causing entanglement of the chain.

Further, when the hook of the crane is moved upward in the state in which the distal ends of the second arms are in contact with the object, the first and second arms expand, so that the distal ends of the second arms can be intruded into the object.

Preferably, conical claws or plate-like claws are provided at the distal ends of the second arms. In this case, the tongs apparatus can hold reliably any object to be suspended, such as a piece of titanium sponge which has a soft surface layer and a substantially cylindrical shape. Preferably, the plate-like claws each have an uneven surface. In this case, the tongs apparatus can hold with ease an object having a smooth surface. Preferably, the conical claws are provided on the lower side of the plate-like claws. In this case, the tongs apparatus can hold an object with improved reliability.

Preferably, elongated members are rotatably connected to the second arms at a position between the crossing point of the second arms and the distal ends of the second arms; and the elongated members are connected to the lifting metal fitting. In this case, since the second arms are supported by the elongated members and therefore open and close by equal amounts, the second arms can hold an object with improved accuracy.

More preferably, the second arms are each formed to have a substantially arcuate shape when viewed from the side and are disposed to intersect each other such that the distal ends of the second arms approach each other.

Preferably, the lifting metal fitting is composed of a base plate, a lifting block provided on the base plate, and a guide pin provided on the lifting block; and the base plate is connected to the elongated members.

When the second arms each have a hollow portion, the lifting metal fitting is disposed in the hollow portion to be located at the crossing position of the second arms.

When the second arms each have a hollow portion, the base plate is formed to have a length slightly greater than the thickness of the second arms, and the elongated members are connected to the opposite ends of the base plate and disposed to sandwich the second arms.

DESCRIPTION OF THE PREFERRED EMBODIMENT

Figure 1:
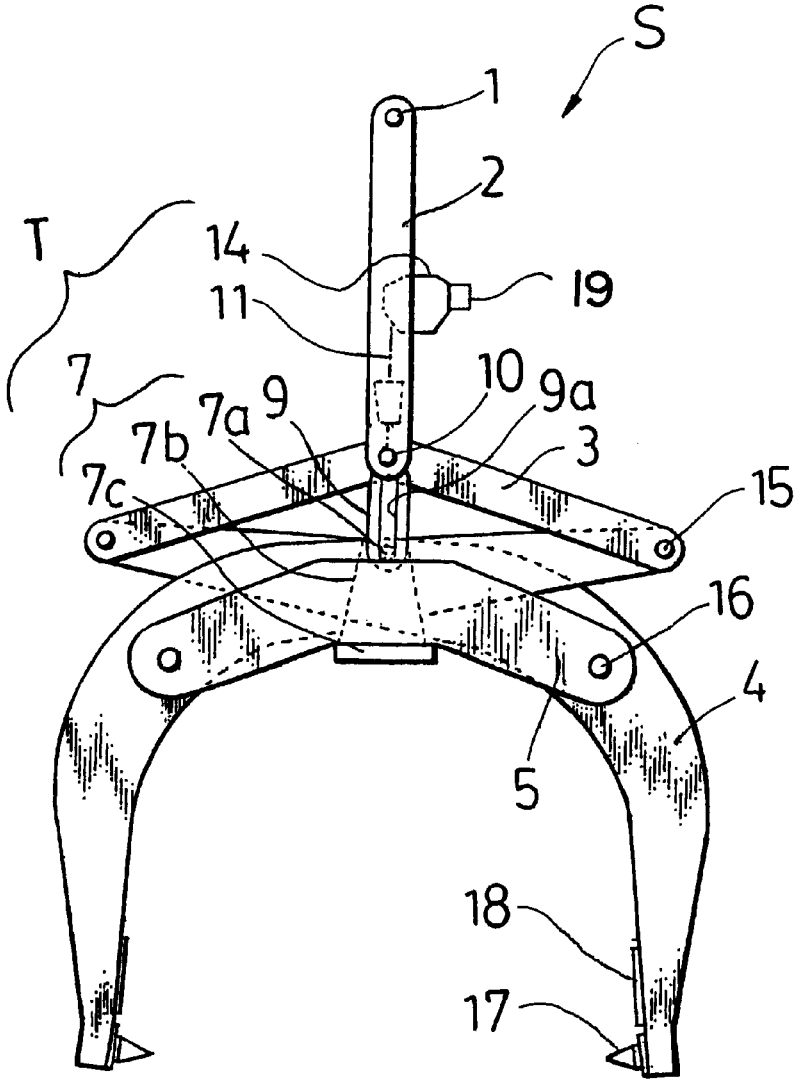
FIG. 1 is a front view of a tongs apparatus according to the present invention.
Figure 2:
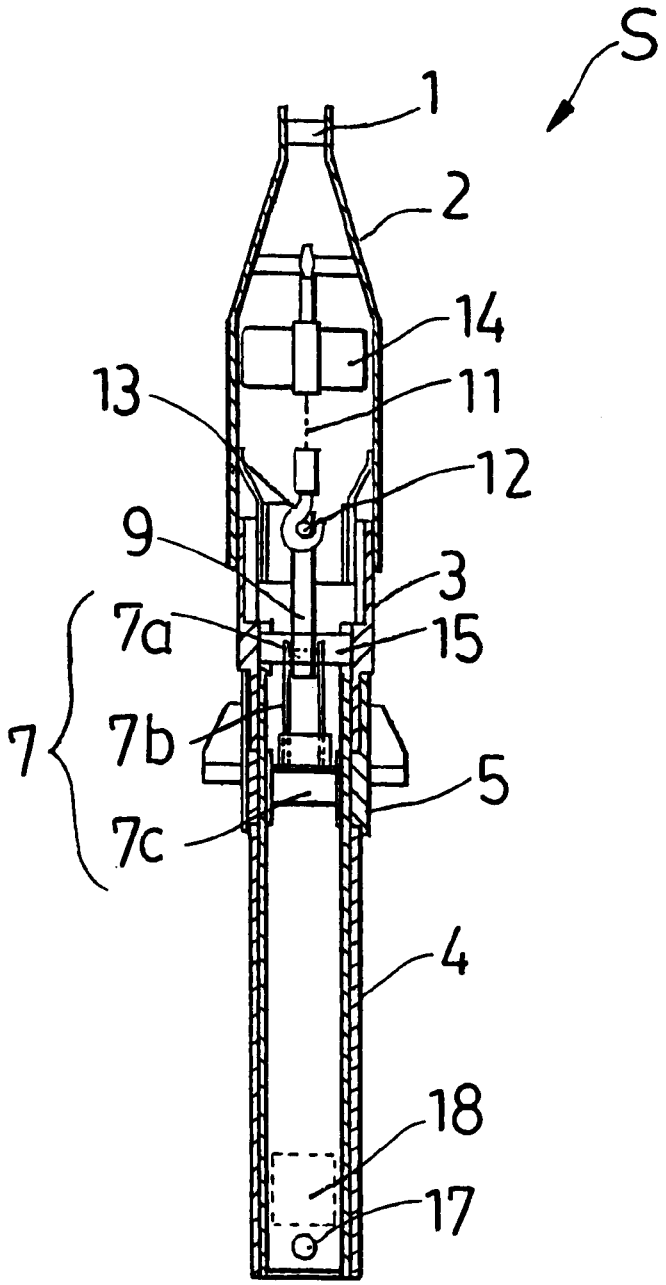
FIG. 2 is a side sectional view of the tongs apparatus according to the present invention.

A tongs apparatus S according to the present embodiment is configured such that cross arms 4 serving as second arms are opened and closed through vertical movement of a motor-driven chain. As shown in FIGS. 1 and 2, the tongs apparatus S comprises, as main structural elements, an upper frame 2 provided on a crane (unillustrated) side; an engagement pin 1 to be engaged with a hook (unillustrated) of the crane; tension bars 3 serving as first arms which are pivotally connected to the upper frame 2; cross arms 4 serving as second arms which are rotatably connected to the tension bars 3 and disposed to cross each other; frames 5 serving as elongated members to which the cross arms 4 are rotatably connected; and a lifting metal fitting 7 formed integrally with the frames 5.

The upper frame 2 is connected to the lifting metal fitting 7 via a ring-shaped member 9 and a chain 11 unwound from the chain motor 14. Upon winding or unwinding of the chain 11, the tension bars 3 and the cross arms 4 rotate about pins 15 and pins 16, respectively, so that the cross arms 4 are opened and closed.

Next will be described the respective members of the tongs apparatus S.

The tongs apparatus S is adapted to suspend an object upon being lifted by the unillustrated crane. The crane and the tongs apparatus S are connected to each other via the upper frame 2. As shown in FIG. 1, the engagement pin 1 is formed on the upper frame 2. The engagement pin 1 is engaged with a hook of the unillustrated crane in order to establish connection between the crane and the tongs apparatus S. In the case of a crane, in place of the engagement pin 1 used in the present embodiment, there may be provided a hole which is formed in the upper frame 2 and through which a hook of the crane is passed for engagement with the upper frame 2.

The pair of tension bars 3 are connected to the upper frame 2. That is, first ends of the tension bars 3 are rotatably connected to the frame 2 via the pin 10, and second ends of the tension bars 3 are rotatably connected to the cross arms 4 via the pins 15. As shown in FIG. 1, the cross arms 4 each have an L-like shape and are disposed to cross each other. Further, the frames 5 are rotatably connected to the cross arms 4 via the pins 16.

As described above, since the frames 5 are rotatably connected to the cross arms 4 and are connected to the lifting metal fitting 7, the cross arms 4 stably open and close while being supported by the frames 5. Thus, the cross arms 4 can hold an object accurately.

The cross arms 4 of the present embodiment have at the free end portions thereof falling-prevention claws 17 for preventing falling of an object, and holding claws 18 for holding the object. These claws are provided in order to reliably hold an object having an uneven surface shape and an object having a soft surface layer.

As shown in FIGS. 1 and 2, the falling-prevention claws 17 are formed in a conical shape having a sharp tip end, such that the falling-prevention claws 17 intrude properly into the object. Each of the holding claws 18 is formed in a flat shape and is attached to a portion of the inner surface of the corresponding cross arm 4, which surface faces the object. From the viewpoint of wear resistance, the holding claws 18 are made of metal. The surfaces of the holding claws 18 may be machined into an uneven surface in order to prevent slippage of the object, which slippage would otherwise occur upon lifting of the object.

Next will be described a supplemental-holding-force apparatus T according to the present embodiment. The supplemental-holding-force apparatus T is composed of the chain motor 14 provided on the upper frame 2, the chain 11, the ring-shaped member 9, and the lifting metal fitting 7.

The lifting metal fitting 7 is composed of a base plate 7*c* formed continuously from and integrally with the frames 5; a lifting block 7*b* provided on the base plate 7*c* and projecting toward the upper frame 2; and a guide pin 7*a* provided on the lifting block 7*b*. The lifting metal fitting 7 is connected to the upper frame 2 via the ring-shaped member 9, which will be described later, interposed between the chain 11 and the guide pin 7*a*.

The ring-shaped member 9 used in the present embodiment has an elongated hole 9*a* which is formed to have a width slightly greater than the diameter of the guide pin 7*a* formed on the lifting block 7*b*. That is, the elongated hole 9*a* can move vertically relative to the guide pin 7*a*.

The chain 11 is unwound from the chain motor 14 provided in the vicinity of the upper frame 2. The chain motor 14 winds and unwinds the chain 11 to thereby regulate the length of the unwound portion of the chain 11. A hook 13 is provided at an end portion of the chain 11 on the side of the ring-shaped member 9. The hook 13 is configured such that the hook 13 can be connected to the engagement portion 12 provided at the upper portion of the ring-shaped member 9.

A detection device 19 is provided on the tongs apparatus S of the present embodiment.

As will be described later, the detection device 19 is configured such that when the upper end portion of the elongated hole 9*a* of the ring-shaped member 9 comes into contact with the guide pin 7*a*, the detection device 19 stops the operation of the chain motor 14 for unwinding the chain 11. Further, during the operation of winding the chain 11 to thereby open the cross arms 4, the detection device 19 stops the operation of winding the chain 11 when the cross arms 4 are fully opened.

Next will be described an object-suspending operation of the tongs apparatus S of the present embodiment and action of the supplemental-holding-force apparatus T.

First, the chain motor 14 is operated to wind the chain to thereby open the cross arms 4 of the tongs apparatus S. Subsequently, the hook of the unillustrated crane is bought into engagement with the pin 1 of the upper frame 2, and the crane is operated to lift the tongs apparatus S. The crane is further operated to move the tongs apparatus S to a position above an object such that the object is located between the cross arms 4.

Subsequently, the crane is operated to lower the hook such that the claws 17 of the cross arms 4 of the tongs apparatus S are stopped at a vertical position corresponding to a desired holding position of the object. In this manner, the holding position of the object is determined. Subsequently, when the chain 11 is unwound from the chain motor 14, the lower portions of the cross arms 4 move inward. Consequently, the distal ends of the cross arms 4 come into contact with the object. At this time, the guide pin 7*a* formed at the upper end portion of the lifting block 7*b* is in contact with the lower end of the elongated hole 9*a* of the ring-shaped member 9. When the chain 11 is unwound further, the ring-shaped member 9 itself is moved downward, while maintaining the sliding contact with the guide pin 7*a*. The unwinding of the chain 11 is continued until the upper end of the elongated hole 9*a* comes into contact with the guide pin 7*a*. Accordingly, due to the weights of the tension bars 3 and the cross arms 4, forces for further lowering the cross arms 4 act on the cross arms 4.

When the upper end of the elongated hole 9*a* comes into contact with the guide pin 7*a* as a result of the downward movement of the ring-shaped member 9, the detection device 19 provided on the chain motor 14 operates to stop the operation of the chain motor 14 for unwinding the chain 11.

When the hook of the crane is lifted after the distal ends of the cross arms 4 come into contact with the object, the tension bars 3 and the cross arms 4 expand, resulting in generation of forces for further closing the cross arms 4. As a result, the object is held by the cross arms 4.

The distance over which the ring-shaped member 9 is lowered may be adjusted in accordance with the shape and physical properties of the object. Further, the length of the ring-shaped member 9 may be changed in accordance with the shape and physical properties of the object to be suspended. That is, in the case in which an object having a soft surface layer is to be suspended and therefore the distal ends of the cross arms 4 must be caused to intrude into the object more deeply, a ring-shaped member 9 having a sufficiently long elongated hole is used. By contrast, in the case in which a hard object having a constant shape is to be suspended, a ring-shaped member 9 having a relatively short hole is used.

Figure 3:
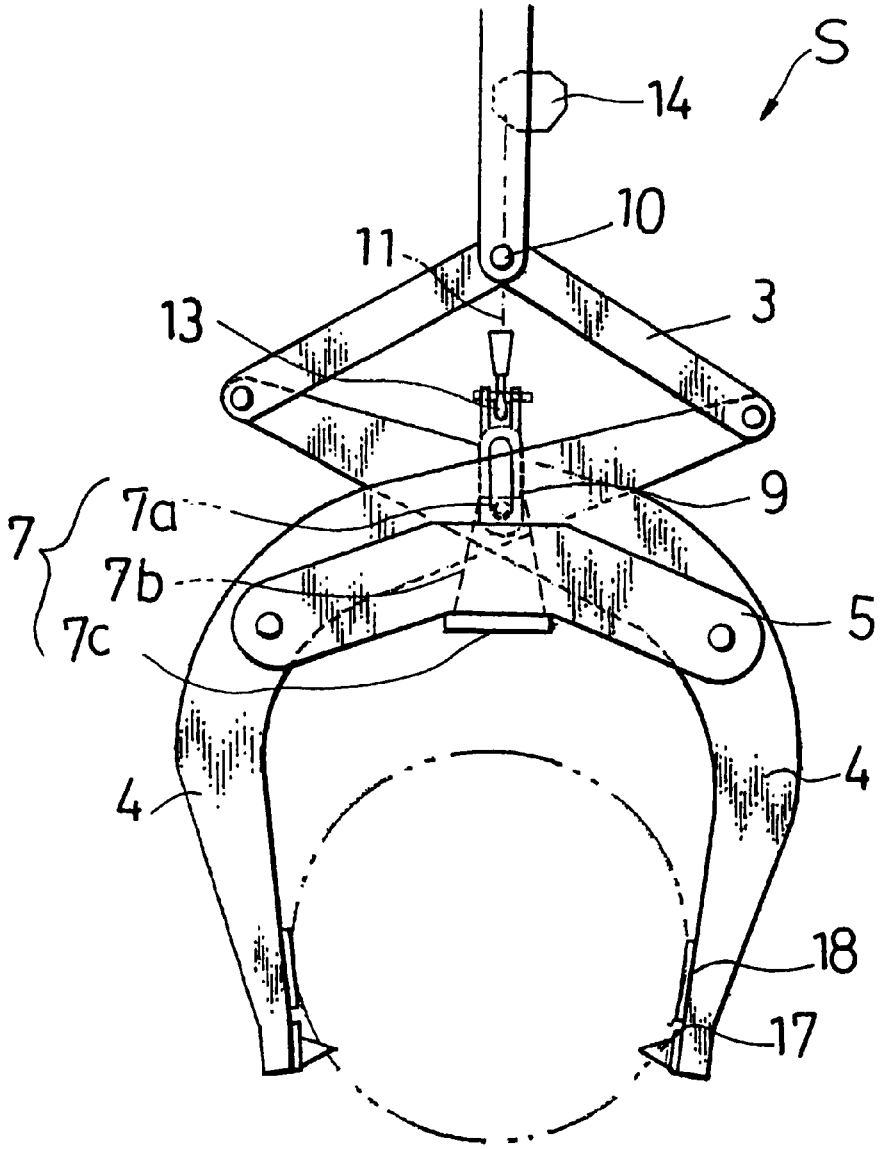
FIG. 3 is an explanatory view showing the tongs apparatus in a state in which the tongs apparatus holds and suspends a substantially cylindrical object in a horizontal orientation.

In the present embodiment, the falling prevention claws 17 having a conical shape and the holding claws 18 having a flat-plate-like shape are provided at the distal ends of the cross arms 4 such that the holding claws 18 are located above the falling prevention claws 17. Therefore, the cross arms 4 can reliably hold any object to be suspended, such as a piece of titanium sponge which has a soft surface layer and a substantially cylindrical shape. Accordingly, as shown in FIG. 3, it becomes possible to suspend a substantially cylindrical object 19 in a horizontal orientation in a state such that the object 19 is held by the holding claws 18 and supported by the falling prevention claws 17 at the lower ends.

Figure 4:
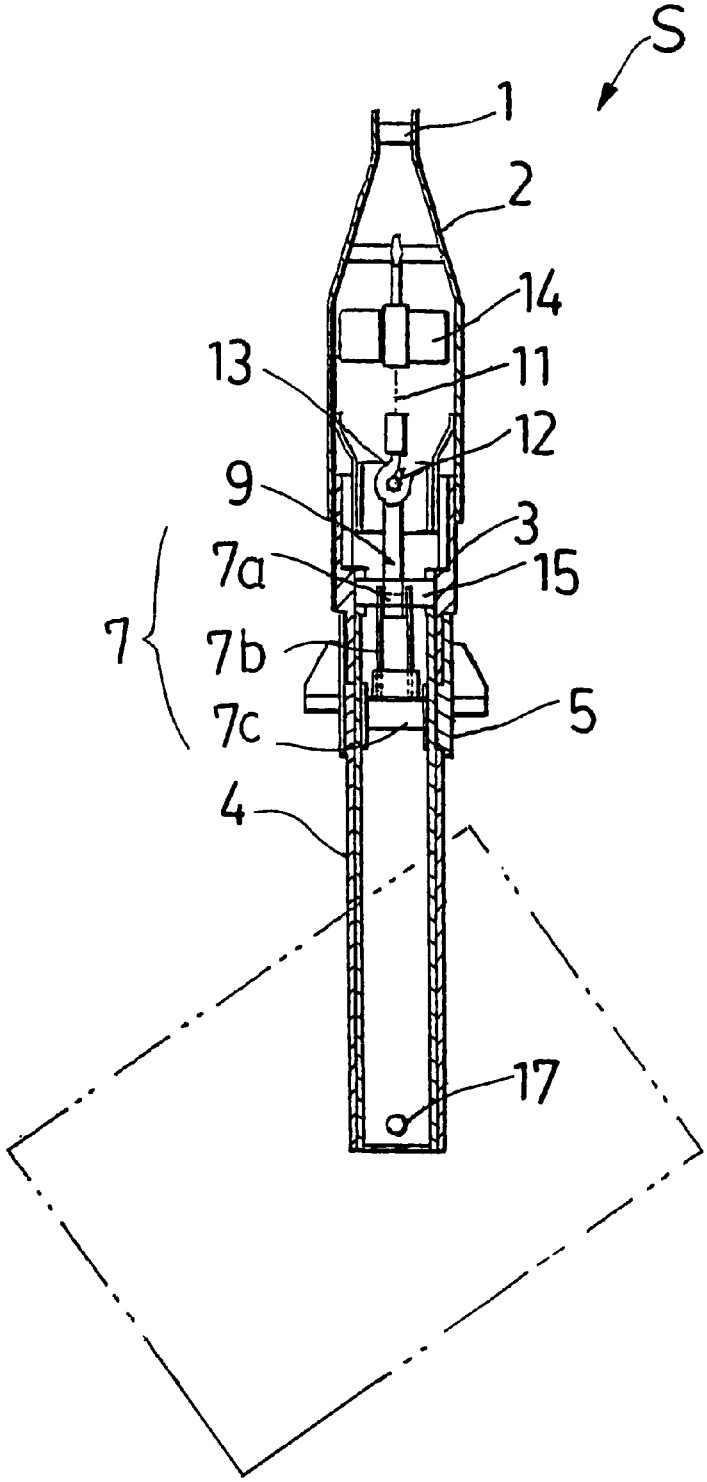
FIG. 4 is a side sectional view showing the tongs apparatus in a state in which the orientation of the object is changed.
Figure 5:
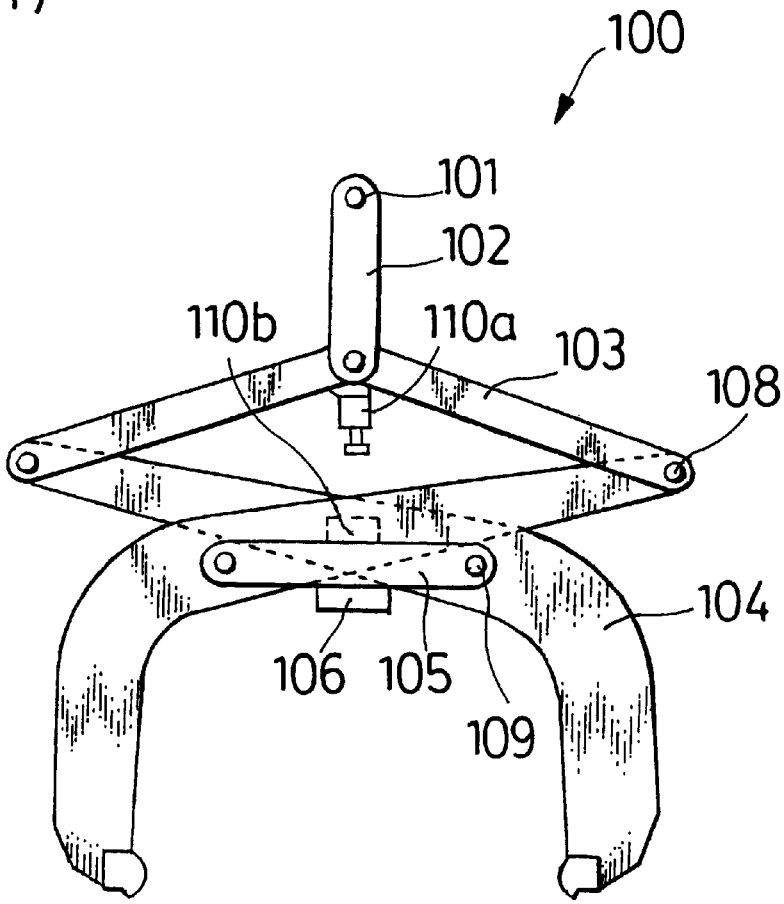
Fig. 5 (PRIOR ART)
FIG. 5 is an explanatory view showing a conventional tongs apparatus.
Figure 6:
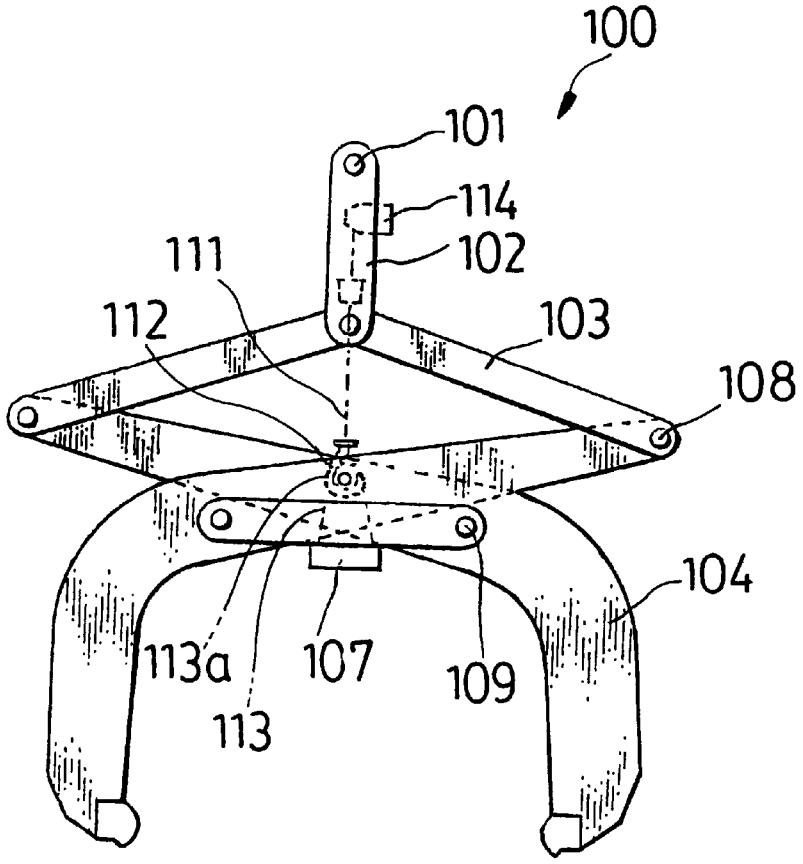
Fig. 6 (PRIOR ART)
FIG. 6 is an explanatory view showing another conventional tongs apparatus.

Moreover, the object in a horizontal orientation can be lifted in a vertical orientation, and the orientation of placement of the object can be changed freely; e.g., from a horizontal placement to a vertical placement, and vice versa. In an exemplary case in which the orientation of the object is changed from horizontal to vertical, as shown in FIG. 4, the object is held by the conical claws at a position offset from the longitudinal center of the object, and the crane is operated to lift the crane hook.

The present invention achieves the following advantageous effects.

In the present invention, the ring-shaped member is interposed between the chain and the lifting metal fitting; and the chain is unwound such that, after the distal ends of the cross arms come into contact with an object, the ring-shaped member is lowered until the upper end portion of the elongated hole of the ring-shaped member comes into contact with the guide pin formed on the lifting metal fitting. Therefore, the claws can be intruded into the object more deeply, without causing excessive unwinding of the chain, which could result in entanglement of the chain.

Further, the tongs apparatus of the embodiment is configured such that the cross arms are opened and closed through winding and unwinding of the chain in order to reliably hold an object. Therefore, the tongs apparatus of the present invention can reliably hold and suspend an object having an uneven surface, such as waste PET bottles crushed and bonded to form a lump. Further, the tongs apparatus of the present invention can reliably hold and suspend an object having a soft surface layer, an uneven surface, and a non-fixed shape, such as a piece of titanium sponge, a log, a piece of concrete, or paper roll, because the distal ends of the cross arms penetrate the surface layer and reach the inner layer of the object.

What is claimed is:

1. A tongs apparatus comprising an upper frame suspended from a crane, a pair of first arms journaled on the upper frame, a pair of second arms journaled on the first arms and disposed to cross each other, and a supplemental-holding-force apparatus, wherein the supplemental-holding-force apparatus comprises:

a chain motor provided on the upper frame;

a chain wound and unwound by the chain motor;

a ring-shaped member connected to a lower end of the chain and having an elongated hole; and a lifting fitting disposed at a crossing point of the second arms or a position closer to the distal ends of the second arms, the lifting fitting having a guide pin slidably engaged with the ring-shaped member, wherein the chain is wound or unwound by the chain motor in order to move the ring-shaped member vertically to thereby supplement a holding force generated through closing of the second arms.

2. A tongs apparatus equipped with said supplemental-holding-force apparatus according to claim 1, additionally comprising a pair of elongated members located on opposing sides of said second arms, each elongated member having opposing ends rotatably connected to the respective second arms at a position between the crossing point of the second arms and the distal ends of the second arms, said elongated members being connected to the lifting fitting.

3. A tongs apparatus equipped with said supplemental-holding-force apparatus according to claim 2, wherein the lifting fitting comprises a base plate, a lifting block provided on the base plate, and a guide pin provided on the lifting block; and the base plate is connected to the elongated members.

4. A tongs apparatus equipped with said supplemental-holding-force apparatus according to claim 3, wherein the second arms each have a hollow portion; and the base plate is formed to have a length slightly greater than the thickness of the second arms, and the elongated members are connected to the opposite ends of the base plate and disposed to sandwich the second arms.

5. A tongs apparatus equipped with said supplemental-holding-force apparatus according to claim 2, wherein the lifting metal fitting comprises a base plate, a lifting block provided on the base plate, and a guide pin provided on the lifting block.

6. A tongs apparatus equipped with said supplemental-holding-force apparatus according to claim 1, wherein the second arms are each formed to have a substantially arcuate shape when viewed from the side and are disposed to intersect each other such that the distal ends of the second arms approach each other.

7. A tongs apparatus equipped with said supplemental-holding-force apparatus according to claim 6, wherein the plate-like claws each have an uneven surface.

8. A tongs apparatus equipped with said supplemental-holding-force apparatus according to claim 1, wherein the lifting fitting comprises a base plate, a lifting block provided on the base plate, and a guide pin provided on the lifting block.

9. A tongs apparatus equipped with said supplemental-holding-force apparatus according to claim 8, wherein the conical claws are provided on the lower side of the plate-like claws.

10. A tongs apparatus equipped with said supplemental-holding-force apparatus according to claim 1, wherein conical claws or plate-like claws are provided at opposed surface of the distal ends of the second arms.

11. A tongs apparatus equipped with said supplemental-holding-force apparatus according to claim 1, wherein the second arms each have a hollow portion; and the lifting fitting is disposed in the hollow portion to be located at the crossing position of the second arms.

12. A tongs apparatus according to claim 1 further comprising a detection device for stopping operation of said motor in unwinding said chain responsive to contact between said guide pin and a top of said elongated hole.

* * * * *